US008053390B2

(12) United States Patent
Hosokawa et al.

(10) Patent No.: US 8,053,390 B2
(45) Date of Patent: Nov. 8, 2011

(54) HEAT-SENSITIVE TRANSFER SHEET

(75) Inventors: Junichiro Hosokawa, Minami-ashigara (JP); Hideyuki Shirai, Minami-ashigara (JP); Hidekazu Sakai, Minami-ashigara (JP); Hisato Nagase, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 375 days.

(21) Appl. No.: 12/415,112

(22) Filed: Mar. 31, 2009

(65) Prior Publication Data

US 2009/0246423 A1 Oct. 1, 2009

(30) Foreign Application Priority Data

Mar. 31, 2008 (JP) ..... 2008-093330

(51) Int. Cl.
*B41M 5/035* (2006.01)
*B41M 5/392* (2006.01)
*B41M 5/50* (2006.01)

(52) U.S. Cl. ..... 503/227; 428/32.67

(58) Field of Classification Search ..... None
See application file for complete search history.

(56) References Cited

FOREIGN PATENT DOCUMENTS

| | | | |
|---|---|---|---|
| EP | 0 429 666 | A1 | 6/1991 |
| JP | 1-146791 | A | 6/1989 |
| JP | 5-32072 | A | 2/1993 |
| JP | 7-101166 | A | 4/1995 |
| JP | 3150691 | A1 | 1/2001 |

OTHER PUBLICATIONS

Japanese Office Action dated Aug. 30, 2011 for corresponding Japanese Patent Application No. 2008-093330.

*Primary Examiner* — Bruce H Hess
(74) *Attorney, Agent, or Firm* — Sughrue Mion, PLLC

(57) ABSTRACT

A heat-sensitive transfer sheet, containing a substrate, at least one thermal transfer layer containing a thermally transferable dye and a resin, disposed on one surface of the substrate, and a heat-resistant slipping layer disposed on another surface of the substrate, wherein said at least one thermal transfer layer contains at least one kind of polymer type releasing agent having a mass-average molecular weight of 5,000 to 100,000 and also having a fluorine-substituted aliphatic group at a side chain of the polymer, and at least one kind of non-polymer type fluorine-system surfactant.

4 Claims, No Drawings

HEAT-SENSITIVE TRANSFER SHEET

FIELD OF THE INVENTION

The present invention relates to a heat-sensitive transfer sheet. In particular, the present invention relates to a heat-sensitive transfer sheet having an improved releasing property, and also having a resistance to variation for environmental conditions at the time of printing.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it enables direct visualization from digital data; it makes reproduction simple, and the like without using treatment chemicals.

Among these methods, in a sublimation type thermal transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated, for example, by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In recent years, because speeding up of a printer can shorten user's waiting time in case that print is conducted in a photo shop for user's advantage, high-speed printers in the sublimation-type thermal transfer recording system, which can provide a print in a short time, have been developed and commercialized one after another.

In wide spread use of the printers in the sublimation-type thermal transfer recording system, there is a demand for a printer providing prints of good image quality under various environmental conditions, independently of an installation site. That is, in order to satisfy user's needs, it is necessary to provide a print of good image quality and free from image defect, not only under the standard air-conditioned environmental condition of offices and shops, for example, at a temperature of 23° C. to 27° C. and a humidity of 50% to 70%, but also, under a high-temperature high-humidity condition in summer (e.g., temperature: 35° C., humidity: 80%) and a low-temperature low-humidity condition in winter (e.g., temperature: 10° C., humidity: 20%).

As one of the technical problems to be solved in the sublimation-type thermal transfer recording system, there is pointed out an image trouble that is caused by a release failure between the heat-sensitive transfer sheet and the heat-sensitive transfer image receiving sheet. In the sublimation-type thermal transfer recording system, the heat-sensitive transfer sheet and the heat-sensitive transfer image receiving sheet are superimposed with each other to form an image. The image is formed on the heat-sensitive transfer image receiving sheet. Therefore, after image formation, it is necessary to strip off the unneeded heat-sensitive transfer sheet from the heat-sensitive transfer image receiving sheet without leaving any unwanted substances on the image receiving sheet. However, from a requirement of reduction in printing time, there is a trend that a temperature applied to the heat-sensitive transfer sheet at the time of recording is raised (a heating time is reduced in keeping with this trend). Consequently, this trend is easy to cause a problem that, after printing, the print and the heat-sensitive transfer sheet are fused to each other, or the heat-sensitive transfer sheet is not successively separated from the heat-sensitive transfer image receiving sheet and thereby a releasing line remains.

For prevention of the heat-sensitive transfer sheet and the heat-sensitive transfer image receiving sheet from fusing, several methods of using a releasing agent such as a silicon compound or a fluorine compound have been proposed. As one of these methods, a method of introducing such the releasing agent into the image receiving sheet has been proposed. However, in a recent sublimation-type thermal transfer recording system, a transparent resin is laminated, in many cases, on the heat-sensitive transfer image receiving sheet having an image formed thereon from viewpoints of improvement in both scratch resistance and light fastness of the formed image. In this embodiment, when a releasing agent is present in the side of the heat-sensitive transfer image receiving sheet, the releasing agent gives, in some cases, disadvantages to the transparent resin laminate.

As an alternative, a method of introducing the releasing agent into the heat-sensitive transfer sheet has been proposed. As the releasing agent that is introduced in this method, a usage of fluorine-system polymers has been also proposed (see Japanese Patent No. 3150691, JP-A-5-32072 ("JP-A" means unexamined published Japanese patent application) and JP-A-1-146791).

SUMMARY OF THE INVENTION

The present invention resides in a heat-sensitive transfer sheet, comprising a substrate, at least one thermal transfer layer containing a thermally transferable dye and a resin, disposed on one surface of the substrate, and a heat-resistant slipping layer disposed on another surface of the substrate, wherein said at least one thermal transfer layer contains at least one kind of polymer type releasing agent having a mass-average molecular weight of 5,000 to 100,000 and also having a fluorine-substituted aliphatic group at a side chain of the polymer, and at least one kind of non-polymer type fluorine-system surfactant.

Other and further features and advantages of the invention will appear more fully from the following description.

DETAILED DESCRIPTION OF THE INVENTION

It has been found that a releasing property can be improved advantageously by introduction of the aforementioned fluorine-system polymer compound into the heat-sensitive transfer sheet, and thereby a problem owing to the releasing line can be solved. However, new problems occurred unexpectedly. For example, it was found that when the heat-sensitive transfer sheet containing the fluorine-system polymer compound was used to form an image in the heat-sensitive transfer image-receiving sheet, specks (spots) on a white background occurred under the conditions of high temperature and high humidity.

As a result of intensive studies on improvement of the trouble of specks on a white background, it has been found that the trouble can be solved by making the aforementioned non-polymer type fluorine-system surfactant coexist in the heat-sensitive transfer sheet.

It should be noted that JP-A-7-101166 discloses a heat-sensitive transfer sheet having a dye layer in which a fluorine-system surfactant is contained, but neither discloses the trouble of specks on a white background that is specifically caused at the time when a heat-sensitive transfer sheet, in which a fluorine-system polymer according to the present invention is contained for the improvement of the releasing property, is printed under the conditions of high temperature and high humidity, nor discloses a method for the improvement thereof.

According to the present invention, there is provided the following means:

(1) A heat-sensitive transfer sheet, comprising a substrate, at least one thermal transfer layer containing a thermally transferable dye and a resin, disposed on one surface of the substrate, and a heat-resistant slipping layer disposed on another surface of the substrate, wherein said at least one thermal transfer layer contains at least one kind of polymer type releasing agent having a mass-average molecular weight of 5,000 to 100,000 and also having a fluorine-substituted aliphatic group at a side chain of the polymer, and at least one kind of non-polymer type fluorine-system surfactant; and (2) The heat-sensitive transfer sheet as described in the above item (1), wherein the non-polymer type fluorine-system surfactant is a compound represented by the following formula (FS):

Formula (FS)

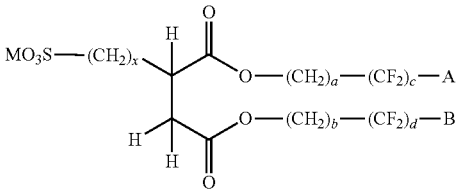

wherein A and B each independently represent a fluorine atom or a hydrogen atom; a and b each independently represent an integer of 1 to 6; c and d each independently represent an integer of 4 to 8; x represents 0 or 1; and M represents a cation.

The present invention is explained in detail below.

First, the heat-sensitive transfer sheet for use in the present invention is explained in detail below.

The heat-sensitive transfer sheet for use in the present invention has a substrate (also referred to as "support") and a thermal transfer layer containing a diffusion transfer dye (hereinafter also referred to as a heat-sensitive thermal transfer layer or a dye layer) formed thereon, and preferably has a transferable protective layer laminate formed on the same substrate, for forming a protective layer composed of a transparent resin on a thermally transferred image by thermal transfer and thus covering and protecting the image.

In the heat-sensitive transfer sheet in the present invention, preferably, dye layers in individual colors of yellow, magenta and cyan, and an optional dye layer in black are repeatedly painted onto a single support in area order in such a manner that the colors are divided from each other. An example of the dye layer is an embodiment wherein dye layers in individual colors of yellow, magenta and cyan are painted onto a single support along the long axial direction thereof in area order, correspondingly to the area of the recording surface of the above-mentioned heat-sensitive transfer image-receiving sheet, in such a manner that the colors are divided from each other. In addition to the three layers above, it may have a black thermal transfer layer. In addition, the thermal transfer sheet preferably has marks indicating the start points of various colors allowing recognition by the printer used.

In the heat-sensitive transfer sheet, each of dyes having their hues is coated on the substrate in such a form that each of the dyes is dispersed in a binder. As the binder that is used for the heat-sensitive transfer sheet of the present invention, various kinds of known binders may be used.

The glass transition temperature of the binder that is used for the heat-sensitive transfer sheet of the present invention is preferably in the range of 98° C. or higher and 150° C. or lower, more preferably from 100° C. or higher and 140° C. or lower, and furthermore preferably from 105° C. or higher and 125° C. or lower.

The glass transition temperature (Tg) is a temperature associated with a change of physical properties that is observed in a polymer compound or the like. Generally, as the polymer compound is heated, it changes from a glassy rigid state to an elastic soft state. This phenomenon is called glass transition. The glass transition temperature (Tg) is defined as a temperature at which the glass transition occurs. Various measuring methods of the glass transition temperature are known. However, the glass transition temperature that is used in the present invention is a temperature that is measured according to the differential scanning calorimetry (DSC) described in JIS K7121-1987.

Examples of the binder polymer compounds that is used for the heat-sensitive transfer sheet of the present invention include acrylic resins such as polyacrylonitrile, polyacrylic acid ester, and polyacrylamide; polyvinyl acetal-based resins such as polyvinyl acetacetal, and polyvinyl butyral; cellulose-base resin such as ethyl cellulose, hydroxyethyl cellulose, ethylhydroxycellulose, hydroxypropyl cellulose, ethylhydroxyethylcellulose, methyl cellulose, cellulose acetate, cellulose acetate butyrate, cellulose acetate propionate, and cellulose nitrate; polyurethane resins; polyamide resins; polyester resins; polycarbonate resins; phenoxy resins; phenol resins; epoxy resins; and various kinds of elastomers. These polymer compounds may be used singly, or in the form of mixture or copolymer thereof.

As the binder that is used in the present invention, polyvinyl acetal-based resins are preferable. More preferable binders are polyvinyl acetacetal-based resins. It is preferable that the acetacetal-based resins that is used in the present invention has a composition in which an acetal content of the resin is 80% by mass or more, and an acetacetal ratio to the acetal content is 90% by mass or more. More preferable is a composition that the acetal content of the resin is 80% by mass or more, and the acetacetal ratio to the acetal content is 95% by mass or more, and most preferable is a composition that the acetal content of the resin is 80% by mass or more, and the acetacetal portion to the acetal content is 99% by mass or more. With respect to the acetal portion, acetacetal and other acetal (for example, butyral) may be mixed within the range of the present invention.

The aforementioned acetal-based resins can be synthesized according to a method that is described in Japanese Patent No. 3065111 and references cited in the Japanese Patent. Further, there are some commercially available products such as S-LEC KS-5 (trade name: Tg 110° C., manufactured by SEKISUI CHEMICAL CO., LTD.), and DENKA BUTYRAL (#5000-D trade name: Tg 110° C., manufactured by DENKI KAGAKU KOGYO K.K.).

In the heat-sensitive transfer sheet of the present invention, it is also one of preferable embodiments to crosslink a binder with a variety of crosslinking agents.

The crosslinking agent is a compound that is able to react with a functional group located at a main chain or a side chain of polymers thereby to bind polymers. The polyvinyl acetal-based resins that are preferably used as a binder of the heat-sensitive transfer sheet of the present invention have an active hydrogen-containing hydroxyl group at the main chain of the resin. Isocyanates having a plurality of isocyanate groups (—N=C=O) in a molecule are preferably used as a crosslinking agent. Specific examples of the isocyanates are listed below.

(1) Diisocyanate Compound

Examples of aromatic diisocyanates include tolylene diisocyanate, diphenylmethane diisocyanate, tolidine diisocyanate, and naphthalene diisocyanate. Examples of aliphatic diisocyanates include hexamethylene diisocyanate, isophorone diisocyanate, xylylene diisocyanate, hydrogenated xylylene diisocyanate, and dicyclohexylmethane diisocyanate.

(2) Triisocyanate Compound

Examples of the triisocyanate compound include trimethylolpropane-modified tolylene diisocyanate, isocyanurate of tolylene diisocyanate, trimethylolpropane-modified hexamethylene diisocyanate, isocyanurate of hexamethylene diisocyanate, biuret of hexamethylene diisocyanate, trimethylolpropane-modified isophorone diisocyanate, isocyanurate of isophorone diisocyanate, triphenylmethane triisocyanate, and tris(isocyanatophenyl)thiophosphate.

Further, a mixture of these isocyanate compounds, or polymers having the isocyanate compound as a component in the main chain or side chain thereof is also preferably used.

These isocyanate compounds are commercially available, for example, from Dainippon Ink & Chemicals Incorporated as a trade name: BURNOCK; Mitsui Chemicals Polyurethanes, Inc. as trade names: TAKENATE, MT-OLESTER; and Nippon Polyurethane Industry Co., Ltd. as a trade name: CORONATE.

The use amount of the isocyanate compounds is preferably in the range of 0.2 to 2.0, and more preferably from 0.3 to 1.5, in terms of equivalent ratio of the isocyanate group (NCO) to the active hydrogen of the binder (H) (NCO/H).

Catalysts may be added in order to accelerate a crosslinking reaction of the binder with the isocyanate compound. Details of the catalysts are described in *Saishin poriuretan zairyo to Oyo Gizyutsu* (Advanced Polyurethane Materials and Applied Technology) (Kabushiki kaisha CMC Shuppan, 2005).

The heat-sensitive transfer sheet that can be used in the present invention contains a polymer type releasing agent having fluorine atom-substituted aliphatic groups on the side chains in the thermal transfer layer.

The polymer type releasing agent having fluorine atom-substituted aliphatic groups on the side chains can be derived from a fluorine atom-substituted aliphatic compound (compound having fluorine atom-substituted aliphatic group(s) on the side chain(s)) produced by a telomerization method (also referred to as a telomer method), or an oligomerization method (also referred to as an oligomer method). The fluorine atom-substituted aliphatic compound can be easily synthesized, for example, by a method described in JP-A-2002-90991.

The fluorine atom-substituted aliphatic group is an aliphatic group, having at least one substituted fluorine atom (straight-chain, branched or cyclic aliphatic group), preferably an alkyl, alkenyl or cycloalkynyl group having 1 to 36 carbon atoms, more preferably an alkyl group having 1 to 36 carbon atoms (preferably 1 to 18, more preferably 1 to 12, furthermore preferably 1 to 10, most preferably 4 to 8) and the aliphatic group may be substituted additionally with groups other than fluorine atom. Examples of the substituent groups include alkyl groups, aryl groups, heteroring groups, halogen atoms other than fluorine atom, a hydroxyl group, alkoxy groups, aryloxy groups, alkylthio groups, arylthio groups, an amino group, alkylamino groups, arylamino groups, heteroring amino groups, acylamino groups, sulfone amino groups, carbamoyl groups, sulfamoyl groups, a cyano group, a nitro group, acyl groups, sulfonyl groups, ureido groups, urethane groups and the like.

In the present invention, the fluorine atom-substituted aliphatic group is most preferably a perfluoroalkyl group.

The polymer type releasing agent having fluorine atom-substituted aliphatic groups on the side chains is preferably a polymer or copolymer of a fluorine atom-substituted aliphatic group-containing monomer. Examples of the preferable monomers thereof include acrylic acid derivatives (e.g., acrylic acids, acrylic esters, and acrylamides, preferably acrylic esters and acrylamides, more preferably acrylic esters) and methacrylic acid derivatives (e.g., methacrylic acids, methacrylic esters, and methacrylamides, preferably methacrylic esters and methacrylamides, more preferably methacrylic esters) having an acyl, alcohol or amide group (substituent group on nitrogen atom) substituted with a fluorine atom-substituted aliphatic group; and acrylonitrile derivatives having a fluorine atom-substituted aliphatic group.

In the case where the polymer type releasing agent having fluorine atom-substituted aliphatic groups on the side chains is a copolymer with a fluorine atom-substituted aliphatic group-containing monomer, examples of the monomers used in combination include acrylates, methacrylates, acrylonitriles, acrylamides, methacrylamides, olefins, styrenes, and the like. Among them, acrylates, methacrylates, acrylonitriles, acrylamides, and methacrylamides are preferable, and acrylates and methacrylates are more preferable. Among them, those having a polyoxyalkylene (e.g., polyoxyethylene, polyoxypropylene) unit in the group substituted on the alcohol group or the amide nitrogen atom are preferable.

In the present invention, the polymer above is preferably a copolymer, which may be a binary copolymer or a ternary or higher copolymer.

As the polymers having a fluorine atom-substituted aliphatic group on the side chains, preferred are copolymers of a monomer having a fluorine atom-substituted aliphatic group and (poly(oxyalkylene))acrylate and/or (poly(oxyalkylene))methacrylate. They may be distributed randomly, or block copolymerized. Examples of the poly(oxyalkylene) group include poly(oxyethylene) group, poly(oxypropylene) group, and poly(oxybutylene) group. Further, the poly(oxyalkylene) group may be a unit having alkylene groups of chain lengths different from each other in the same chain, such as poly(block connecter of oxyethylene, oxypropylene and oxyethylene) and poly(block connecter of oxyethylene and oxypropylene). Further, the copolymer of a monomer having a fluorine atom-substituted aliphatic group and (poly(oxyalkylene))acrylate (or methacrylate) is not limited to binary copolymers, but may be ternary or higher copolymers that can be produced by copolymerizing, at the same time, several different monomers such as monomers having two or more different kinds of fluorine atom-substituted aliphatic groups and two or more different kinds of (poly(oxyalkylene))acrylate (or methacrylate).

A mass-average molecular weight of the polymers having a fluorine atom-substituted aliphatic group at the side chain ranges preferably from 5,000 to 100,000, more preferably from 8,000 to 50,000, and further preferably from 10,000 to 40,000.

Examples of the copolymer type releasing agent include copolymers of acrylate (or methacrylate) having a perfluorobutyl group (—$C_4F_9$) and (poly(oxyalkylene))acrylate (or methacrylate); copolymers of acrylate (or methacrylate) having a perfluorobutyl group, (poly(oxyethylene))acrylate (or methacrylate) and (poly(oxypropylene))acrylate (or methacrylate); copolymers of acrylate (or methacrylate) having a perfluorohexyl group (—$C_6F_{13}$) and (poly(oxyalkylene))acrylate (or methacrylate); copolymers of acrylate (or methacrylate) having a perfluorohexyl group, (poly(oxyethylene))acrylate (or methacrylate) and (poly(oxypropylene))acrylate (or methacrylate); copolymers of acrylate (or methacrylate) having a perfluorooctyl group (—$C_8F_{17}$) and (poly(oxyalkylene))acrylate (or methacrylate); and copolymers of acrylate (or methacrylate) having a perfluorooctyl group, (poly(oxyethylene))acrylate (or methacrylate) and (poly(oxypropylene))acrylate (or methacrylate).

Further, the polymers having a fluorine atom-substituted aliphatic group on the side chains in the present invention are commercially available as a general name such as "perfluoroalkyl-containing oligomers". For example, the following products can be used.

As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (each product name). As the products of Sumitomo 3M Limited, there are Novec™ FC-4430 and FC-4432 (each product name).

The polymer type releasing agent having fluorine atom-substituted aliphatic groups on the side chains in the present invention is preferably nonionic (having no dissociable group in water such as sulfo or carboxyl group), and more preferably, it is water-soluble to a certain degree. The phrase "water soluble to a certain degree" means that the polymer compound has solubility in pure water of 1% or more at 25° C. Specifically, the polymer is, for example, a polymer compound having hydroxyl groups or the oxyalkylene groups described above, and favorable examples thereof include water-soluble compounds such as Megafac F-470, Megafac F-472SF, Megafac F-477, Megafac F-479, Megafac F-480SF, Megafac F-484, and Megafac F-486 (all trade names, manufactured by Dainippon Ink and Chemicals, Inc.).

The reason why the polymer type releasing agent having fluorine atom-substituted aliphatic groups on the side chains in the present invention is preferably nonionic and soluble in water to a certain degree is not yet to be understood, but is assumed as follows.

The nonionic polymer type releasing agent having fluorine atom-substituted aliphatic groups on the side chains is suitably compatible with the dye and the binder in the thermal transfer layer and present stably in the layer during storage of the heat-sensitive transfer sheet, and thus, it is unlikely to cause troubles such as acceleration of dye bleeding out. On the other hand, the polymer type releasing agent, which is suitably compatible, because of its water solubility, with the receiving layer of the heat-sensitive transfer image-receiving sheet having a latex, seems to leach out to the interface between the heat-sensitive transfer sheet and the heat-sensitive transfer image-receiving sheet during printing under a high-temperature high-humidity condition, thereby it shows effective releasing action.

The polymer type releasing agent having fluorine atom-substituted aliphatic groups on the side chains may be contained to any one of the thermal transfer layers in yellow, magenta, cyan, and black as needed, and may be contained in a single thermal transfer layer or in multiple thermal transfer layers. It is preferably contained to each of the yellow, magenta and cyan thermal transfer layers.

The addition amount of the polymer compound having fluorine atom-substituted aliphatic groups on the side chains may be determined properly according to the kinds and amounts of the dye and the binder used, but the amount is preferably 0.01% to 20%, more preferably 0.1% to 10%, and still more preferably 0.2% to 5%, with respect to the total solid content (mass) in the thermal transfer layer.

The following is an explanation of non-polymer type fluorine-system surfactants that are used in the heat-sensitive transfer sheet of the present invention.

As to the non-polymer type fluorine-system surfactant that is used in the present invention, the molecular weight of the surfactant is preferably 1700 or less, and known surfactants may be used. The molecular weight of the surfactant is preferably in the range of 100 or more and 1500 or less, and more preferably from 300 or more and 1000 or less.

Preferable examples of the non-polymer type fluorine-system surfactant include an ammonium, potassium, or lithium salt of perfluoroalkylsulfonic acid, an ammonium, potassium, or lithium salt of perfluoroalkylcarboxylic acid, perfluoroalkyl quaternary ammonium iodide, perfluoroalkyl polyoxyethyleneethanol, perfluoroalkyl betaine, perfluoroalkyl phosphoric acid ester, perfluoroalkylamine oxide, perfluoroalkylacrylate, and fluorinated alkyl esters.

The non-polymer type fluorine-system surfactant that is used in the present invention is more preferably a compound represented by the following formula (FS). The formula (FS) is explained in detail below.

Formula (FS)

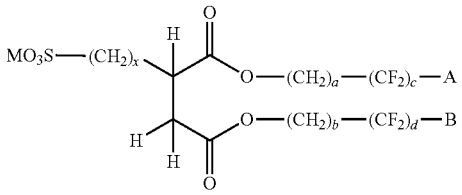

In formula (FS), A and B each independently represent a fluorine atom or a hydrogen atom. a and b each independently represent an integer of 1 to 6. c and d each independently represents an integer of 4 to 8. M represents a cation.

Herein, it is preferable that both A and B are fluorine atoms, or alternatively hydrogen atoms, and more preferably both A and B are fluorine atoms. It is preferable that a and b each are an integer of 1 to 6 and a is equal to b. It is more preferable that a and b each represent an integer of 2 or 3 and a is equal to b. It is furthermore preferably both a and b are 2.

It is preferable that c and d each are an integer of 4 to 6 and c is equal to d. It is more preferable that c and d each are an integer of 4 or 6 and c is equal to d. It is most preferable that both c and d are 4.

x represents 0 or 1, each of which is equally preferable.

M represents a cation. As the cation to be represented by M, it is preferable to use alkali metal ions (for example, lithium, sodium, and potassium ions), alkali earth metal ions (for example, barium, and calcium ions), ammonium ion or the like. Of these ions, lithium, sodium, and potassium, and ammonium ions are particularly preferable.

Of the compounds represented by formula (FS), the compounds represented by the following formula (FS-a) are more preferable.

Formula (FS-a)

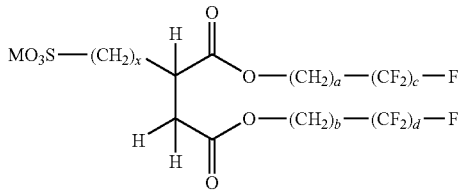

In formula (FS-a), a, b, c, d, M, and x each have the same meanings as those of formula (FS), and a preferable range of each of these symbols is the same as that of formula (FS).

Of the compounds represented by formula (FS), the compounds represented by the following formula (FS-b) are more preferable.

Formula (FS-b)

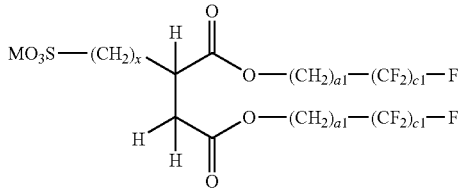

In formula (FS-b), a1 represents an integer of 2 to 3. c1 represents an integer of 4 to 6. M represents a cation. x represents 0 or 1.

a1 is preferably 2. c1 is preferably 4. As x, each of 0 and 1 is equally preferable.

Specific examples of the non-polymer type fluorine-system surfactant are shown below. However, the present invention is not limited to these compounds.

FS-1

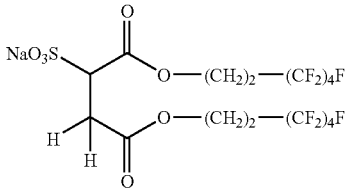

FS-2

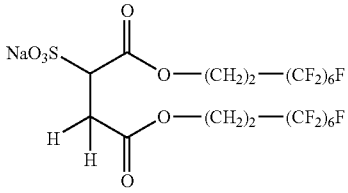

-continued

FS-3

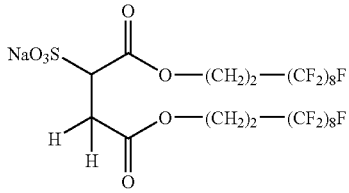

FS-4

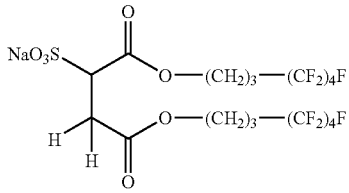

FS-5

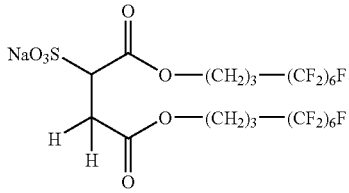

FS-6

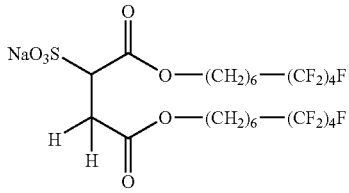

FS-7

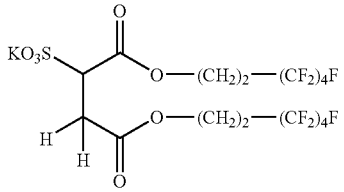

FS-8

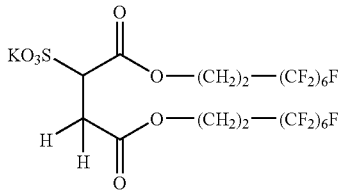

FS-9

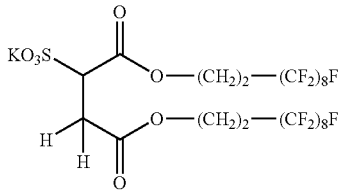

FS-10

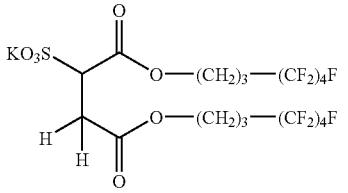

-continued
FS-11
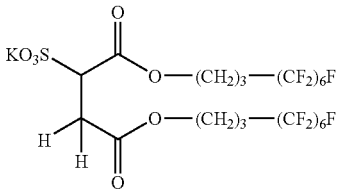
FS-12
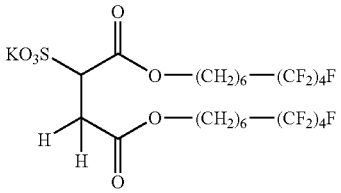
FS-13
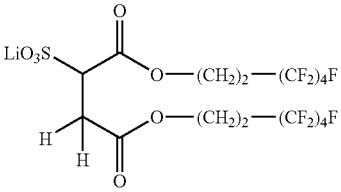
FS-14
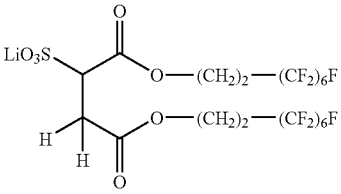
FS-15
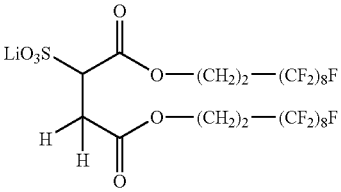
FS-16
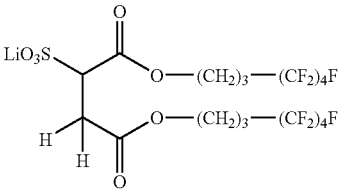
FS-17
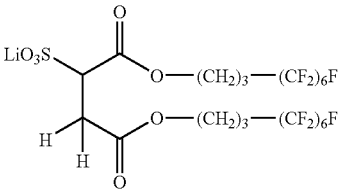
FS-18
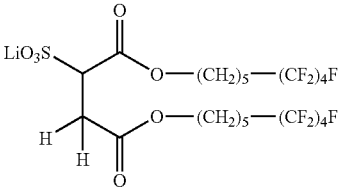
-continued
FS-19
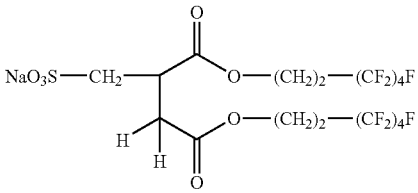
FS-20
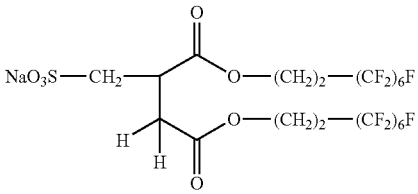
FS-21
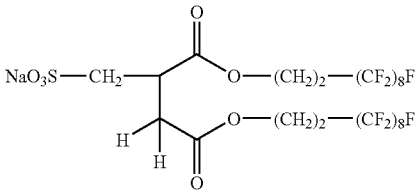
FS-22
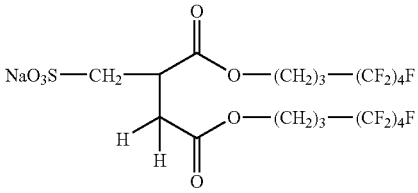
FS-23
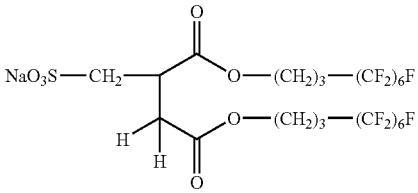
FS-24
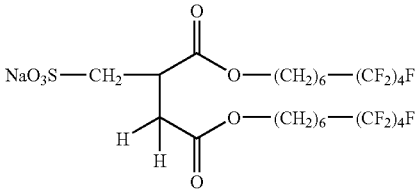
FS-25
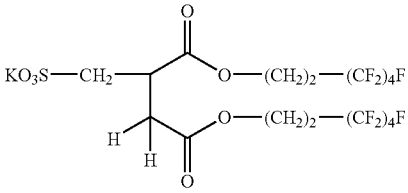
FS-26
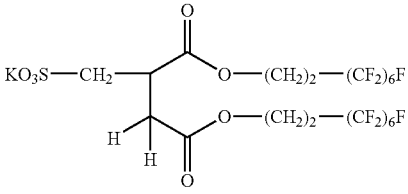

-continued

FS-27

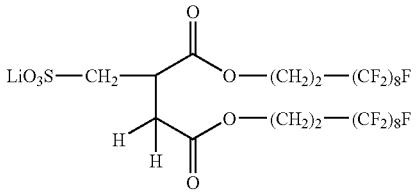

FS-28

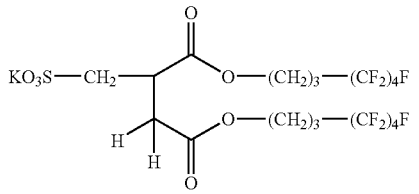

FS-29

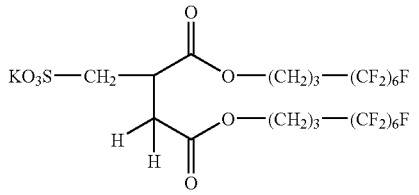

FS-30

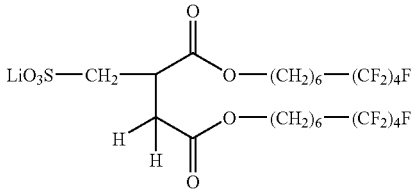

FS-31

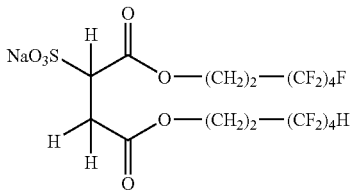

FS-32

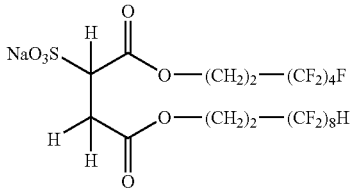

These compounds can be easily synthesized according to a method described in JP-A-2004-75717.

In the present invention, when the aforementioned surfactant is used in the heat-sensitive transfer sheet, the surfactant may be dissolved in any kind of solvent to prepare a coating composition. Other components may be optionally contained in the composition, if necessary.

When the coating composition is prepared, the surfactant for use in the present invention may be used in combination of two or more kinds. Alternatively, two kinds of surfactants consisting of the surfactant for use in the present invention and other optional surfactant may be used. Further, the surfactant may be used in combination of three or more kinds. Examples of the other surfactant that can be used in combination include anionic, cationic, or nonionic surfactants, and they may be polymer surfactants. Of these surfactants, anionic, or nonionic surfactants are more preferable. Specific examples of the other surfactant that can be used in combination include those described in, for example, JP-A-62-215272 (pp. 649-706), Research Disclosure (RD), Item 17643, pp. 26-27 (December 1978), ibid., Item 18716, p. 650 (November 1979), and ibid., Item 307105, pp. 875-876 (November 1989).

The use amount of the compounds represented by formula (FS) is not particularly limited, and may be changed optionally depending on the chemical structure of the surfactant, and the kind or amount of the compounds that are contained in a coating composition as well as the constitution of media thereof.

The addition amount of the non-polymer type fluorine-system surfactant for use in the present invention is preferably in the range of 0.001 to 5% relative to the total solid content (mass) of the thermal transfer layer in which the non-polymer type fluorine-system surfactant is contained. When the addition amount is too small, effects that are attained by the surfactant are small. On the other hand, when the addition amount is too large, there is a possibility that adverse effect such as a cissing trouble might be caused. In view of the above, a more preferable addition amount is in the range of 0.01 to 2% by mass.

In the present invention, the heat transfer layer generally contains a sublimation-type dye and a binder. The heat transfer layer may further contain waxes, silicone resins, and polymer particles and inorganic particles, in accordance with necessity.

Each dye in the dye layers is preferably contained in an amount of 20 to 80 mass % of the dye layer, preferably in that of 30 to 70 mass % thereof.

The coating of the dye layer (i.e., the painting of a coating liquid for the dye layer) is performed by an ordinary method such as roll coating, bar coating, gravure coating, or gravure reverse coating. The coating amount of the dye layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the thermal transfer layer is preferably from 0.1 to 2.0 μm, more preferably from 0.2 to 1.2 μm.

The dyes for use in the present invention is not particularly limited, so far as the dyes are able to diffuse by heat and able to be incorporated in a heat-sensitive transfer sheet, and able to transfer by heat from the heat-sensitive transfer sheet to an image-receiving sheet. The dyes that have been conventionally used for the heat-sensitive transfer sheet or known dyes can be used.

Preferable examples of the dyes include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93.

Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. These are not limited thereto. Further, dyes each having a different hue from each other as described above may be arbitrarily combined together.

Each of the dye layers may have a mono-layered structure or a multi-layered structure. In the case of the multi-layered structure, the individual layers constituting the dye layer may be the same or different in composition.

In the present invention, a transferable protective layer laminate is preferably formed in area order onto the heat-sensitive transfer sheet. The transferable protective layer laminate is used for forming a protective layer composed of a transparent resin on a thermally transferred image by thermal transfer and thus covering and protecting the image, thereby to improve durability such as scratch resistance, light-fastness, and resistance to weather. This laminate is effective in the case where the transferred dye is insufficient in image durabilities such as light resistance, scratch resistance, and chemical resistance in the state that the dye is naked in the surface of an image-receiving sheet.

The transferable protective layer laminate can be formed by forming, onto a substrate, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a substrate on which an easy adhesive layer has already been formed.

In the present invention, as a transferable protective layer-forming resin, preferred are resins that are excellent in scratch resistance, chemical resistance, transparency and hardness. Examples of the resin include polyester resins, acrylic resins, polystyrene resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins. These resins may be crosslinked with various crosslinking agents.

In the heat-sensitive transfer sheet that is used in the present invention, it is preferred to dispose a heat-resistant slipping layer (a back side layer) on the surface (back side) of the substrate opposite to the thermal transfer layer coating side, namely on the same side as the surface which contacts with a thermal head, and the like. In addition, in the case of the protective layer transfer sheet, it is also preferred to dispose a heat-resistant slipping layer (a back side layer) on the surface (back side) of the substrate opposite to the transferable protective layer coating side, namely on the same side as the surface which contacts with a thermal head, and the like.

If the heat-sensitive transfer sheet is heated by a heating device such as a thermal head in the state such that the back side of the support of the transfer sheet directly contacts with the heating device, heat fusion is apt to occur. In addition, owing to a large friction between them, it is difficult to smoothly transfer the heat-sensitive transfer sheet at the time of printing.

The heat-resistant slipping layer (back side layer) is disposed so that the heat-sensitive transfer sheet enables to withstand heat energy from a thermal head. The heat-resistant slipping layer prevents the heat fusion, and enables a smooth traveling action. In recent years, the necessity of the heat-resistant slipping layer is becoming greater on the grounds that the heat energy from a thermal head is increasing in association with speeding-up of the printer.

The heat-resistant slipping layer is formed by coating a composition wherein additives such as a sliding agent, a releasing agent, a surfactant, inorganic particles, organic particles, and pigments are added to a binder. Further, an interlayer may be disposed between the heat-resistant slipping layer and the support. As the interlayer, there has been disclosed a layer containing inorganic fine particles and a water-soluble resin or a hydrophilic resin capable of emulsification.

The heat-sensitive transfer image-receiving sheet that can be used in the image-forming method of the present invention will be described in detail hereinafter.

The heat-sensitive transfer image-receiving sheet has a support and at least one receiving layer containing a thermoplastic dye-receiving polymer formed thereon. The receiving layer may contain an ultraviolet absorbent, a releasing agent, a lubricant, an antioxidant, a preservative, a surfactant, and other additives. Between the support and the receiving layer may be formed an intermediate layer such as a heat insulating layer (porous layer), a gloss control layer, a white background adjusting layer, a charge control layer, an adhesive layer, or a primer layer. The heat-sensitive transfer image-receiving sheet preferably has at least one heat insulating layer between the support and the receiving layer.

The receiving layer and these interlayers are preferably formed by simultaneous multilayer coating, and a multiple number of these interlayers may be formed as needed.

A curling control layer, a writing layer, or a charge-control layer may be formed on the backside of the support. Each of these layers may be coated on the backside of the support by using a usual method such as a roll coating, a bar coating, a gravure coating, and a gravure reverse coating.

In the present invention, the heat-sensitive transfer image-receiving sheet contains a latex polymer having a glass transition temperature (Tg) of 20° C. or higher and 60° C. or lower in the receiving layer. The glass transition temperature of the latex polymer is preferably 25° C. or higher and 55° C. or lower.

In the present invention, use of a dyeable latex polymer is preferable. As the latex polymer, multiple latex polymers may be used. In such a case, at least one latex polymer is necessary to have a glass transition temperature (Tg) in the range above, and most preferably, all latex polymers contained have glass transition temperatures (Tgs) in the range above.

The latex polymer is generally a dispersion of fine particles of thermoplastic resins in a water-soluble dispersion medium. Examples of the thermoplastic resins used for the latex polymer according to the present invention include polycarbonates, polyesters, polyacrylates, vinyl chloride copolymers, polyurethane, styrene-acrylonitrile copolymers, polycaprolactone and the like.

Among them, polycarbonates, polyesters, and vinyl chloride copolymers are preferable, polyesters and vinyl chloride copolymers are particularly preferable.

The polyester is prepared by condensation of dicarboxylic acid derivatives and diol compounds, and may include aromatic rings and saturated carbon rings as well as water-soluble groups for imparting dispersibility thereto.

Examples of the vinyl chloride copolymers include vinyl chloride-vinyl acetate copolymers, vinyl chloride-acrylate copolymers, vinyl chloride-methacrylate copolymers, vinyl chloride-vinyl acetate-acrylate copolymers, vinyl chloride-acrylate-ethylene copolymers and the like. As described above, it may be a binary copolymer or a ternary or higher copolymer, and the monomers may be distributed randomly or block-copolymerized.

The copolymer may contain auxiliary monomer components such as vinylalcohol derivatives, maleic acid derivatives, and vinyl ether derivatives. The copolymer preferably contain vinyl chloride components in an amount of 50 mass % or more, and auxiliary monomer components such as maleic acid derivatives and vinyl ether derivatives in an amount of 10 mass % or less.

The latex polymers may be used alone or as a mixture. The latex polymer may have a uniform structure or a core/shell structure, and in the latter case, the resins constituting the core and shell respectively may have different glass transition temperatures.

Commercially available acrylate latexes include Nipol LX814 (Tg: 25° C.) and Nipol LX857X2 (Tg: 43° C.) (all, trade names, manufactured by ZEON CORPORATION) and others.

Commercially available polyester latexes include Vylonal MD-1100 (Tg: 40° C.), Vylonal MD-1400 (Tg: 20° C.), Vylonal MD-1480 (Tg: 20° C.) and MD-1985 (Tg: 20° C.) (all, trade names, manufactured by Toyobo Co., Ltd.) and others.

Commercially available vinyl chloride copolymers include Vinybran 276 (Tg: 33° C.) and Vinybran 609 (Tg: 48° C.) produced by Nissin Chemical Industry Co., Ltd., Sumielite 1320 (Tg: 30° C.) and Sumielite 1210 (Tg: 20° C.) (all, trade names, manufactured by Sumika Chemtex Co., Ltd.) and others.

The addition amount of the latex polymer (latex polymer solid content) is preferably 50 to 98 mass %, more preferably 70 to 95 mass %, with respect to all polymers in the receiving layer. The average particle diameter of the latex polymer is preferably 1 to 50,000 nm, more preferably 5 to 1,000 nm.

In the present invention, the heat insulation layer preferably contains a hollow polymer.

The hollow polymer in the present invention is a polymer particle having voids inside of the particle and preferably an aqueous dispersion containing this hollow polymer particle. Examples of the hollow polymer particles include (1) non-foaming type hollow polymer particles obtained in the following manner: a dispersion medium such as water is contained inside of a capsule wall formed of a polystyrene, acrylic resin, or styrene/acrylic resin, and the like; and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

Of these, the non-foaming hollow polymer particles of the foregoing (1) are preferred. If necessary, use can be made of a mixture of two or more kinds of the polymer particles. Specific examples of the above (1) include Rohpake HP-1055, manufactured by Rohm and Haas Co.; SX866(B), manufactured by JSR Corporation; and Nippol MH5055, manufactured by ZEON CORPORATION (all of these product names are trade names).

The average particle diameter (particle size) of the hollow polymer particles is preferably 0.1 to 5.0 μm, more preferably 0.2 to 3.0 μm, and particularly preferably 0.4 to 1.4 μm.

The hollow ratio (percentage of void) of the hollow polymer is preferably in the range of 20% to 70%, and particularly preferably 30% to 60%.

In the present invention, the particle size of the hollow polymer particles is calculated after measurement of the circle-equivalent diameter of the periphery of the particles under a transmission electron microscope. The average particle diameter is determined by measuring the circle-equivalent diameter of the periphery of at least 300 hollow polymer particles observed under the transmission electron microscope and obtaining the average thereof The hollow ratio of the hollow polymer particles is calculated by the ratio of the volume of voids to the volume of a particle.

As for the resin properties of the hollow polymer for use in the heat-sensitive transfer image-receiving sheet according to the present invention, the glass transition temperature (Tg) is preferably 70° C. or higher and 200° C. or lower, more preferably, 90° C. or higher and 180° C. or lower. The hollow polymer is particularly preferably a hollow latex polymer.

The heat-sensitive transfer image-receiving sheet, that can be used in the image-forming method of the present invention, may contain a water-soluble polymer in the receiving layer and/or the heat insulation layer. Herein, the "water-soluble polymer" means a polymer which dissolves, in 100 g of water at 20° C., in an amount of preferably 0.05 g or more, more preferably 0.1 g or more, further preferably 0.5 g or more.

Examples of the water-soluble polymers for use in the heat-sensitive transfer image-receiving sheet according to the present invention include carrageenans, pectin, dextrin, gelatin, casein, carboxymethylcellulose, hydroxyethylcellulose, hydroxypropylcellulose, polyvinylpyrrolidone, polyvinylpyrrolidone copolymers, polyvinylalcohol, polyethylene glycol, polypropylene glycol, water-soluble polyesters, and the like. Among them, gelatin and polyvinylalcohol are preferable.

Gelatin having a molecular weight of 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

The gelatin above may contain a known crosslinking agent such as aldehyde-type crosslinking agent, N-methylol-type crosslinking agent, vinylsulfone-type crosslinking agent, or chlorotriazine-type crosslinking agent. Among the crosslinking agents above, vinylsulfone-type and chlorotriazine-type crosslinking agents are preferable, and typical examples thereof include bisvinylsulfonylmethylether, N,N'-ethylene-bis(vinylsulfonylacetamido)ethane, and 4,6-dichloro-2-hydroxy-1,3,5-triazine or the sodium salt thereof.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano et al., "Poval", Kobunshi Kankokai, Inc. are useful. The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For a typical example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117 and PVA-117H; partially saponificated polyvinyl alcohol such as PVA-203, PVA-205, PVA-210 and PVA-220; and modified polyvinyl alcohols such as C-118, HL-12E, KL-118 and MP-203 (all of these names are trade names, manufactured by KURARAY CO., LTD.).

In the present invention, the receiving layer of the heat-sensitive transfer image-receiving sheet may contain the polymer compound having fluorine atom-substituted aliphatic groups on the side chains described above. In such a case, it may contain a polymer compound identical with or different in kind from the polymer compound having fluorine atom-substituted aliphatic groups on the side chains contained in the heat-sensitive transfer sheet, and both cases are preferable embodiments of the present invention. It may also contain, as releasing agent, a known polyethylene wax, a solid wax such as amide wax, a silicone oil, a phosphate ester compound, a fluorine-system surfactant or a silicone-based surfactant.

The content of the polymer compound having fluorine atom-substituted aliphatic groups on the side chains is 0.01% to 20%, preferably 0.1% to 10% and more preferably 1% to 5%, with respect to the total solid content (mass) in the receiving layer.

In the image-forming method (system) of the present invention, imaging is achieved by superposing a heat-sensitive transfer sheet on a heat-sensitive transfer image-receiving sheet so that a heat transfer layer of the heat-sensitive transfer sheet is in contact with a receptor layer of the heat-sensitive transfer image-receiving sheet and giving thermal energy in accordance with image signals given from a thermal head.

Specifically, an image-forming can be achieved by the similar manner to that as described in, for example, JP-A-2005-88545. In the present invention, a printing time is preferably less than 15 seconds, and more preferably in the range of 3 to 12 seconds, and further preferably 3 to 7 seconds, from the viewpoint of shortening a time taken until a consumer gets a print.

In order to accomplish the above-described printing time, a line speed at the time of printing is preferably 0.73 msec/line or less, and further preferably 0.65 msec/line or less. Further, from the viewpoint of improvement in transfer efficiency as one of speeding-up conditions, the maximum ultimate temperature of the thermal head at the time of printing is preferably in the range of 180° C. or higher and 450° C. or lower, more preferably 200° C. or higher and 450° C. or lower, and furthermore preferably 350° C. or higher and 450° C. or lower.

The method of the present invention may be utilized for printers, copying machines and the like, which employ a heat-sensitive transfer recording system. As a means for providing heat energy in the thermal transfer, any of the conventionally known providing means may be used. For example, application of a heat energy of about 5 to 100 mJ/mm$^2$ by controlling recording time in a recording device such as a thermal printer (e.g., trade name: Video Printer VY-100, manufactured by Hitachi, Ltd.), sufficiently attains the expected result. Also, the heat-sensitive transfer image-receiving sheet for use in the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

According to the present invention, it is possible to improve the releasing property, and also to improve the trouble of specks on a white background that is caused at the time when the heat-sensitive transfer sheet is printed under the conditions of high temperature and high humidity.

According to the present invention, it is possible to dissolve a problem of the releasing property, namely a trouble of fusion of a heat-sensitive transfer sheet and a heat-sensitive transfer image-receiving sheet, or a trouble of a releasing residue owing to a failure of continuous release. Further, it is possible to provide a heat-sensitive transfer sheet capable of improving the trouble of specks on a white background that is caused at the time when the heat-sensitive transfer sheet is printed under the conditions of high temperature and high humidity.

The present invention will be described in more detail based on the following examples, but the invention is not intended to be limited thereto. In the following Examples, the terms "part" and "%" are values by mass, unless they are indicated differently in particular.

EXAMPLES

Example 1

(Preparation of Heat-Sensitive Transfer Sheet)

Sample 101 was Prepared as Follows.

A polyester film 4.5 μm in thickness (trade name: Lumirror 5A-F595, manufactured by TORAY INDUSTRIES, INC.), that was subjected to an easy-adhesion-treatment on one surface of the film, was used as a support. The following back side-layer coating liquid was applied onto the support on the other surface that was not subjected to the easy-adhesion-treatment, so that the coating amount based on the solid content after drying would be 1 g/m$^2$. After drying, the coating liquid was cured by heat at 50° C.

Coating liquids, which will be detailed later, were used to form, onto the painted surface of the thus-formed polyester film, individual heat-sensitive transfer layers in yellow, magenta and cyan, and a transferable protective layer laminate in area order by painting. In this way, a heat-sensitive transfer sheet was prepared. The solid coating amount in each of the heat-sensitive transfer layers (dye layers) was set to 0.8 g/m$^2$.

In the formation of the transferable protective layer laminate, a releasing-layer-coating liquid was painted, the resultant was dried, a protective-layer-coating liquid was painted thereon, the resultant was dried, and then an adhesive-layer-coating liquid was painted thereon.

| Back side layer-coating liquid | |
|---|---|
| Acrylic polyol resin (trade name: ACRYDIC A-801, manufactured by Dainippon Ink and Chemicals, Incorporated) | 17.3 mass parts |
| Zinc stearate (trade name: SZ-2000, manufactured by Sakai Chemical Industry Co., Ltd.) | 0.26 mass part |
| Phosphate ester (trade name: Phoslex A18, manufactured by Sakai Chemical Industry Co., Ltd.) | 0.52 mass part |
| Phosphate ester (trade name: PLYSURF-A217, manufactured by Dai-ichi Kogyo Seiyaku Co., Ltd.) | 3.59 mass parts |
| Talc (trade name: MICRO ACE L-1, manufactured by NIPPON TALC Co., Ltd.) | 0.52 mass part |

-continued

| | |
|---|---|
| Magnesium oxide (trade name: STARMAG PSF, manufactured by Konoshima Chemical Co., Ltd.) | 0.07 mass part |
| Polyisocyanate (trade name: BURNOCK D-800, manufactured by Dainippon Ink and Chemicals, Incorporated) | 7.77 mass parts |
| Methyl ethyl ketone/Toluene (2/1, at mass ratio) | 70 mass parts |

Yellow-dye-layer-coating liquid

| | |
|---|---|
| Dye (Y-1) | 0.8 mass part |
| Dye (Y-2) | 0.4 mass part |
| Dye (Y-3) | 4.2 mass parts |
| Dye (Y-4) | 1.7 mass parts |
| Polyvinylacetal resin (trade name: DENKA BUTYRAL #5000-D, manufactured by DENKI KAGAKU KOGYO K.K.) | 7.3 mass parts |
| Fluorine-system polymer type releasing agent FK-1 (The compound for use in the present invention) (trade name: Megafac F-472SF, manufactured by Dainippon Ink and Chemicals, Incorporated) | 0.1 mass part |
| Non-polymer type fluorine-system surfactant FT-1 (The compound for use in the present invention) (trade name: Zonyl FSA*** (***Zonyl FSA is lithium fluorocarbonate that is an anionic and water-soluble compound.), manufactured by Du Pont) | 0.01 mass part |
| Matting agent (trade name: FLO-THENE UF, manufactured by SUMITOMO SEIKA CHEMICALS CO., LTD) | 0.12 mass part |
| Methylethy ketone/Toluene (2/1, at mass ratio) | 85 mass parts |

Y-1

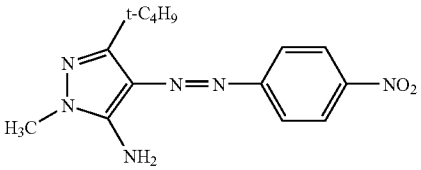

Y-2

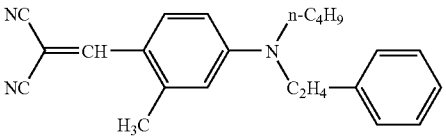

Y-3

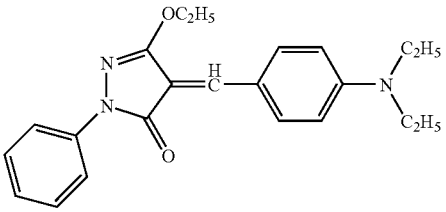

Y-4

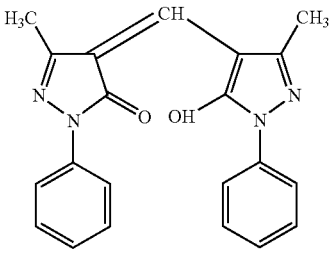

Magenta-dye-layer-coating liquid

| | |
|---|---|
| Dye (M-1) | 0.4 mass part |
| Dye (M-2) | 0.4 mass part |
| Dye (M-3) | 6.5 mass parts |
| Polyvinylacetal resin (trade name: DENKA BUTYRAL #5000-D, manufactured by DENKI KAGAKU KOGYO K.K.) | 7.7 mass parts |
| Fluorine-system polymer type releasing agent FK-1 (The compound for use in the present invention) (trade name: Megafac F-472SF, manufactured by Dainippon Ink and Chemicals, Incorporated) | 0.1 mass part |
| Non-polymer type fluorine-system surfactant FT-1 (The compound for use in the present invention) (trade name: Zonyl FSA (Zonyl FSA is lithium fluorocarbonate that is an anionic and water-soluble compound.), manufactured by Du Pont) | 0.01 mass part |
| Matting agent (trade name: FLO-THENE UF, manufactured by SUMITOMO SEIKA CHEMICALS CO., LTD.) | 0.12 mass part |
| Methylethy ketone/Toluene (2/1, at mass ratio) | 85 mass parts |

M-1

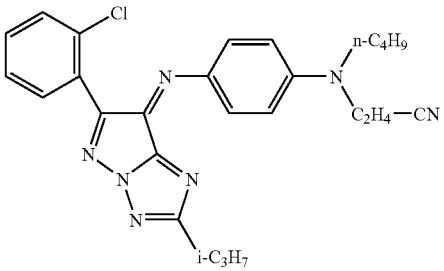

M-2

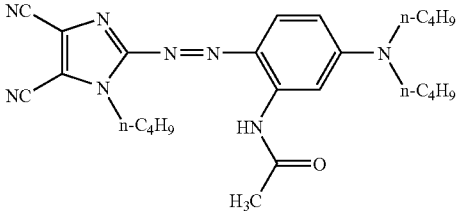

M-3

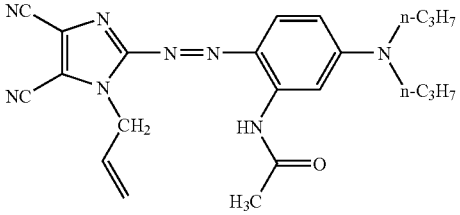

Cyan-dye-layer-coating liquid

| | |
|---|---|
| Dye (C-1) | 0.2 mass part |
| Dye (C-2) | 6.7 mass parts |
| Dye (C-3) | 0.3 mass part |
| Polyvinylacetal resin (trade name: DENKA BUTYRAL #5000-D, manufactured by DENKI KAGAKU KOGYO K.K.) | 8.0 mass parts |
| Fluorine-system polymer type releasing agent FK-1 (The compound for use in the present invention) (trade name: Megafac F-472SF, manufactured by Dainippon Ink and Chemicals, Incorporated) | 0.1 mass part |
| Non-polymer type fluorine-system surfactant FT-1 (The compound for use in the present invention) (trade name: Zonyl FSA (Zonyl FSA is lithium fluorocarbonate that is an anionic and water-soluble compound.), manufactured by Du Pont) | 0.01 mass part |
| Matting agent (trade name: FLO-THENE UF, manufactured by SUMITOMO SEIKA CHEMICALS CO., LTD.) | 0.12 mass part |
| Methylethy ketone/Toluene (2/1, at mass ratio) | 85 mass parts |

C-1

-continued

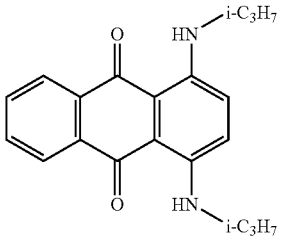

C-2

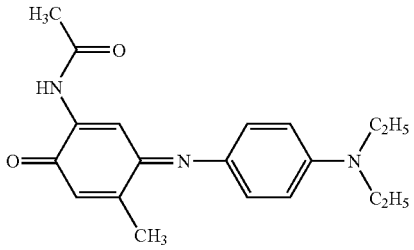

C-3

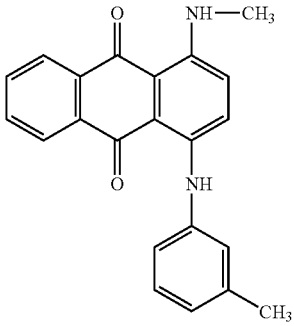

Transferable Protective Layer Laminate

On the same polyester film as used in the preparation of the dye layers as described above, coating liquids of a releasing layer, a protective layer and an adhesive layer each having the following composition were coated, to form a transferable protective layer laminate. Coating amounts of the releasing layer, the protective layer and the adhesive layer after drying were 0.5 g/m$^2$, 1.0 g/m$^2$ and 1.8 g/m$^2$, respectively.

| Releasing-layer-coating liquid | |
|---|---|
| Modified cellulose resin (trade name: L-30, manufactured by DAICEL CHEMICAL INDUSTRIES, LTD.) | 5.0 mass parts |
| Methyl ethyl ketone | 95.0 mass parts |
| Protective-layer-coating liquid | |
| Acrylic resin (trade name: DIANAL BR-100, manufactured by MITSUBISHI RAYON CO., LTD.) | 35 mass parts |
| Isopropanol | 75 mass parts |
| Adhesive-layer-coating liquid | |
| Acrylic resin (trade name: DIANAL BR-77, manufactured by MITSUBISHI RAYON CO., LTD.) | 25 mass parts |
| The following ultraviolet absorbent UV-1 | 1.5 mass parts |
| The following ultraviolet absorbent UV-2 | 1.5 mass parts |
| The following ultraviolet absorbent UV-3 | 1.2 mass parts |
| The following ultraviolet absorbent UV-4 | 0.8 mass part |

-continued

| | |
|---|---|
| Silicone resin fine particles (trade name: TOSPEARL 120, manufactured by MOMENTIVE Performance Materials Japan LLC.) | 0.06 mass part |
| Methyl ethyl ketone/toluene (2/1, at mass ratio) | 70 mass parts |

(UV-1)

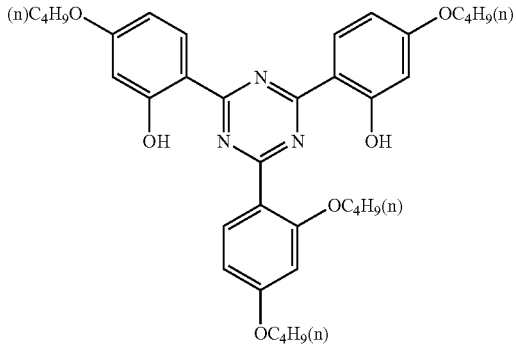

(UV-2)

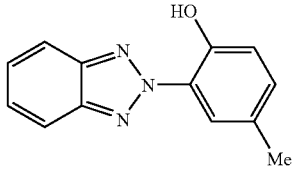

(UV-3)

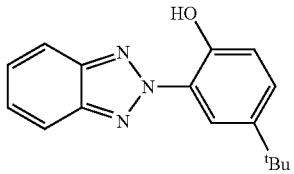

(UV-4)

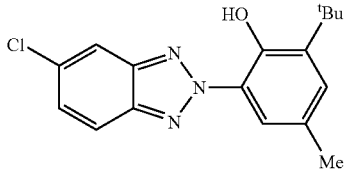

(Preparation of Heat-Sensitive Transfer Image-Receiving Sheet Z-1)

A paper support, on both sides of which polyethylene was laminated, was subjected to corona discharge treatment on the surface thereof, and then a gelatin undercoat layer containing sodium dodecylbenzenesulfonate was disposed on the treated surface. A subbing layer, a heat insulation layer, a lower receptor layer and an upper receptor layer each having the following composition were simultaneously multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No.2,761,791. The coating was performed so that the coating amounts of the subbing layer, the heat insulation layer, the lower receptor layer and the upper receptor layer after drying would be 6.0 g/m$^2$, 8.5 g/m$^2$, 2.4 g/m$^2$ and 3.0 g/m$^2$, respectively. After drying, the resultant support was subjected to a heat treatment at 30° C. for 5 days to perform a crosslinking reaction of gelatin with a crosslinking agent. The resultant support was processed in a fit form for a printer configuration to prepare heat-sensitive transfer image-receiving sheet (Z-1).

| Upper receptor layer | |
|---|---|
| Vinyl chloride-series latex (Tg: 73° C.) (trade name: Vinybran 900, manufactured by Nissin Chemical Industry Co., Ltd.) | 21.0 mass parts |
| Vinyl chloride-series latex (Tg: 33° C.) (trade name: Vinybran 276, manufactured by Nissin Chemical Industry Co., Ltd.) | 1.6 mass parts |
| Gelatin (10% aqueous solution) | 2.5 mass parts |
| The following ester-series wax EW-1 | 1.8 mass parts |
| The following surfactant F-1 | 0.1 mass part |
| The following surfactant F-2 | 0.4 mass part |
| Lower receptor layer | |
| Vinyl chloride-series latex (Tg: 46° C.) (trade name: Vinybran 690, manufactured by Nissin Chemical Industry Co., Ltd.) | 18.0 mass parts |
| Vinyl chloride-series latex (Tg: 73° C.) (trade name: Vinybran 900, manufactured by Nissin Chemical Industry Co., Ltd.) | 8.0 mass parts |
| Gelatin (10% aqueous solution) | 8.0 mass parts |
| The following surfactant F-1 | 0.03 mass part |
| Heat insulation layer | |
| Styrene/acrylic hollow latex polymer (average diameter: 0.5 μm) (trade name: Nipol MH5055, manufactured by ZEON CORPORATION) | 66.0 mass parts |
| Gelatin (10% aqueous solution) | 24.0 mass parts |
| 2,4-dichloro-6-hydroxy-1,3,5-s-triazine sodium salt (crosslinking agent) | 0.1 mass part |
| Subbing layer | |
| Polyvinyl alcohol (trade name: POVAL PVA 205, manufactured by KURARAY CO., LTD.) | 7.0 mass parts |
| Styrene butadiene rubber latex (trade name: SN-307, manufactured by NIPPON A & L INC.) | 55.0 mass parts |
| The following Surfactant F-1 | 0.02 mass part |

(EW-1)

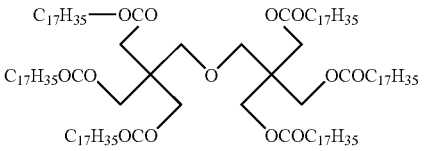

(F-1)

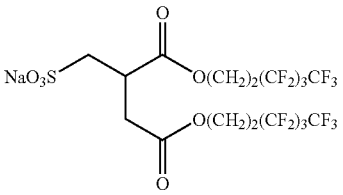

F-2

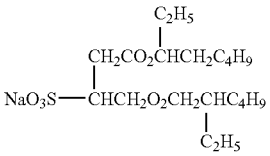

Samples 102 to 108 were prepared in the same manner as Sample 101, except that at least one of the fluorine-system polymer type releasing agent and the non-polymer type fluorine-system surfactant, each of which was contained in each of the yellow dye layer, the magenta dye layer, and the cyan dye layer, was changed as shown in Table 1. When the kind of the compound was changed, the compound was replaced in an amount (mass) equal to the compound of Sample 101, respectively.

(Evaluation of Releasing Residue and Fusion)

Using a combination of the aforementioned heat-sensitive transfer sheet and the aforementioned heat-sensitive transfer image-receiving sheet, print properties under the following storage/environmental conditions were evaluated. Evaluation of the image formation method was performed by using a printer (trade name: Fuji Film Thermal Photo Printer ASK-2000L manufacture by FUJIFILM Corporation).

Samples for print were left under the environmental conditions set forth below. Thereafter, 30 copies of the image having a size of 127 mm×89 mm were continuously output from the printer under the following environmental conditions to obtain prints. The releasing residue and fusion on the output images of the twenty fifth copy to the thirtieth copy were evaluated according to the following criteria. Three kinds of images, namely a portrait (indoor), a portrait (outdoor night scene), and a black solid image, were conducted in the output image. Sensory evaluation was performed by five testers to obtain an average value of their evaluation ranks.

Storage/Print Environmental Condition

The heat-sensitive transfer sheet prepared as described above was stored under the environment of temperature 25° C. and humidity 55% for 1 day.

The heat-sensitive transfer sheet stored as described above, the aforementioned heat-sensitive transfer image-receiving sheet, and the printer were left under the environment of temperature 35° C. and humidity 90% for 24 hours, followed by printing under the same conditions as above.

(Evaluation Rank of Releasing Residue and Fusion)

5: No releasing residue was detected by visual observation.

4: Some releasing residue was detected but only to the degree allowing appreciation of image without difficulty.

3: Releasing residue prohibited appreciation of image, depending on the kind of image.

2: Releasing residue prohibited appreciation of image observed, independently of the kind of image.

1: Fusion of heat-sensitive transfer sheet and heat-sensitive transfer image-receiving sheet was observed.

(Evaluation of Specks on a White Background)

The evaluation of specks on a white background was performed in the same manner as the valuation of releasing residue and fusion, except that the storage/environmental conditions were replaced by the following conditions, and further the image to be evaluated was replaced by two images consisting of a white solid image and a portrait (indoor).

Storage/Print Environmental Condition

The heat-sensitive transfer sheet prepared as described above was stored under the environment of temperature 40° C. and humidity 80% for 2 days.

The heat-sensitive transfer sheet stored as described above, the aforementioned heat-sensitive transfer image-receiving sheet, and the printer were left under the environment of temperature 40° C. and humidity 80% for 12 hours, followed by printing under the same conditions as above.

(Evaluation Rank of Specks on a White Background)

5: No speck was detected by visual observation.

4: Some specks were detected by visual observation, but only to the degree allowing appreciation of white solid image as well as portrait image without difficulty.

3: Specks were detected by visual observation, to the degree prohibiting appreciation of white solid image, but not prohibiting appreciation of portrait image.

2: Specks prohibited appreciation of image observed, regardless of the kind of image.

1: Extremely many specks were detected by visual observation.

TABLE 1

| Sample No. | Remarks | Fluorine-system polymer type releasing agent | Non-polymer type fluorine-system surfactant | Releasing residue and fusion | Specks on white background |
|---|---|---|---|---|---|
| 108 | This invention | FK-1 | FT-1 | 4.5 | 3.9 |
| 102 | Comparative example | FK-1 | None | 4.5 | 1.8 |
| 103 | Comparative example | None | None | 1.9 | 1.7 |
| 104 | Comparative example | None | FS-1 | 2.0 | 3.8 |
| 105 | This invention | FK-1 | FS-1 | 4.8 | 4.7 |
| 106 | This invention | FK-2 | FS-1 | 4.6 | 4.7 |
| 107 | This invention | FK-3 | FS-1 | 4.4 | 4.6 |
| 108 | This invention | FK-1 | FS-10 | 4.7 | 4.6 |

TABLE 2

| Fluorine-system polymer type releasing agent | | |
|---|---|---|
| Sample | Additive | Compound classification |
| FK-1 | Megafac F-472SF (trade name, manufactured by Dainippon Ink and Chemicals, Ltd.) | Polymer compound having a fluorine atom-substituted aliphatic group at its side chain; nonionic and water-soluble |
| FK-2 | Megafac F-479 (trade name, manufactured by Dainippon Ink and Chemicals, Ltd.) | Polymer compound having a fluorine atom-substituted aliphatic group at its side chain; nonionic and water-soluble |
| FK-3 | Megafac F-483 (trade name, manufactured by Dainippon Ink and Chemicals, Ltd.) | Polymer compound having a fluorine atom-substituted aliphatic group at its side chain; nonionic and water-insoluble |

From Table 1, it is apparent that the heat-sensitive transfer sheets of the present invention are improved not only in releasing residue and fusion, but also in trouble of specks on a white background, as compared to Comparative Examples.

Having described our invention as related to the present embodiments, it is our intention that the present invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-093330 filed in Japan on Mar. 31, 2008, which is entirely herein incorporated by reference.

What we claim is:

1. A heat-sensitive transfer sheet, comprising a substrate, at least one thermal transfer layer containing a thermally transferable dye and a resin, disposed on one surface of the substrate, and a heat-resistant slipping layer disposed on another surface of the substrate, wherein said at least one thermal transfer layer contains at least one kind of polymer type releasing agent having a mass-average molecular weight of 5,000 to 100,000 and also having a fluorine-substituted aliphatic group at a side chain of the polymer, and at least one kind of non-polymer type fluorine-system surfactant.

2. The heat-sensitive transfer sheet according to claim 1, wherein the non-polymer type fluorine-system surfactant is a compound represented by the following formula (FS):

Formula (FS)

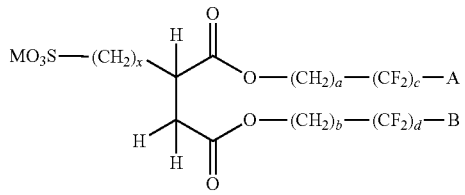

wherein A and B each independently represent a fluorine atom or a hydrogen atom; a and b each independently represent an integer of 1 to 6; c and d each independently represent an integer of 4 to 8; x represents 0 or 1; and M represents a cation.

3. The heat-sensitive transfer sheet according to claim 1, wherein the non-polymer type fluorine-system surfactant is a compound represented by the following formula (FS-a):

Formula (FS-a)

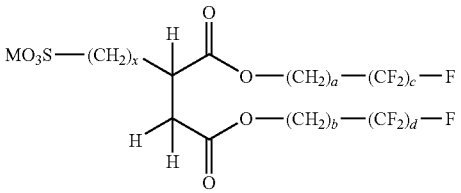

wherein a, b, c, d, M, and x each have the same meanings as those of formula (FS).

4. The heat-sensitive transfer sheet according to claim 1, wherein the non-polymer type fluorine-system surfactant is a compound represented by the following formula (FS-b):

Formula (FS-b)

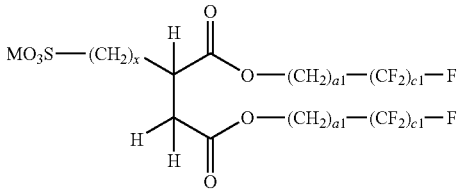

wherein a1 represents an integer of 2 to 3; c1 represents an integer of 4 to 6; M represents a cation; and x represents 0 or 1.

* * * * *